US011253016B2

(12) United States Patent
Blunt et al.

(10) Patent No.: US 11,253,016 B2
(45) Date of Patent: Feb. 22, 2022

(54) GOALKEEPER GLOVE

(71) Applicant: NIKE, Inc., Beaverton, OR (US)

(72) Inventors: Matthew Blunt, Beaverton, OR (US); Linda Castleberry, Beaverton, OR (US); Ken Clark, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 121 days.

(21) Appl. No.: 16/623,239

(22) PCT Filed: Jun. 22, 2018

(86) PCT No.: PCT/US2018/038904
§ 371 (c)(1),
(2) Date: Dec. 16, 2019

(87) PCT Pub. No.: WO2018/237219
PCT Pub. Date: Dec. 17, 2018

(65) Prior Publication Data

US 2021/0145093 A1 May 20, 2021

Related U.S. Application Data

(60) Provisional application No. 62/524,130, filed on Jun. 23, 2017.

(51) Int. Cl.
*A41D 19/00* (2006.01)
*A41D 19/015* (2006.01)
*A63B 71/14* (2006.01)

(52) U.S. Cl.
CPC ... *A41D 19/01547* (2013.01); *A41D 19/0044* (2013.01); *A41D 19/01523* (2013.01);
(Continued)

(58) Field of Classification Search
CPC ..... A41D 19/0044; A41D 19/01582; A41D 19/01547; A63B 71/143; A63B 71/146; A63B 71/148
See application file for complete search history.

(56) References Cited

U.S. PATENT DOCUMENTS 1,584,304 A * 5/1926 Kennedy ..... A63B 71/148 2/16
3,533,108 A * 10/1970 Feldser ..... A41B 7/06 2/124

(Continued)

FOREIGN PATENT DOCUMENTS

FR 929320 A 12/1947
WO WO-2006076491 A2 7/2006

OTHER PUBLICATIONS

European Patent Office (ISA), International Preliminary Report on Patentability for International Application No. PCT/US2018/038904, dated Jan. 2, 2020.

(Continued)

*Primary Examiner* — Tajash D Patel
(74) *Attorney, Agent, or Firm* — Honigman LLP; Matthew H. Szalach; Jonathan O'Brien

(57) ABSTRACT

A glove is provided and includes a cuff providing an opening to the glove. A back panel defines a first portion of finger sheaths and a thumb sheath and extends along the finger sheaths and the thumb sheath to the cuff. A palm panel is disposed on an opposite side of the glove from the back panel and defines a second portion of the finger sheaths and the thumb sheath. The palm panel is formed from a material having a greater coefficient of friction than a material of the back panel and extends along the finger sheaths and the thumb sheath to the cuff. The palm panel tapers in a direction from the finger sheaths to the cuff. A gusset extends between and is attached to the back panel and the palm panel and is formed from a different material than the back panel and the palm panel.

18 Claims, 10 Drawing Sheets

(52) U.S. Cl.
CPC ..... *A63B 71/148* (2013.01); *A41D 2300/50* (2013.01); *A41D 2400/80* (2013.01); *A41D 2600/10* (2013.01)

(56) References Cited

U.S. PATENT DOCUMENTS 4,570,269 A * 2/1986 Berlese ..... A41D 19/01523 2/16
5,749,098 A * 5/1998 Evans ..... A41D 19/0041 2/123
8,205,269 B2 * 6/2012 Anderson ..... A63B 71/146 2/161.2
8,397,313 B2 * 3/2013 Bevier ..... A41D 19/01582 2/159
2005/0155134 A1 7/2005 McLin
2006/0195965 A1 * 9/2006 Knuth ..... A41D 19/0062 2/159
2007/0006362 A1 1/2007 Estrella
2008/0256677 A1 * 10/2008 Loos ..... A41D 19/0041 2/69
2012/0030856 A1 2/2012 Bevier
2013/0041302 A1 * 2/2013 Williams ..... A63B 23/14 602/22
2013/0263354 A1 10/2013 Gibby
2014/0026281 A1 * 1/2014 Kleinert ..... A63B 71/146 2/20
2016/0366958 A1 * 12/2016 Hochmuth ..... B32B 7/08
2018/0279700 A1 * 10/2018 Huber ..... A41D 13/081

OTHER PUBLICATIONS

European Patent Office (ISA), International Search Report and Written Opinion for International Application No. PCT/US2018/038904, dated Dec. 3, 2018.

* cited by examiner

GOALKEEPER GLOVE

CROSS REFERENCE TO RELATED APPLICATIONS

This application is the National Phase of International Application No. PCT/US2018/038904, filed Jun. 22, 2018, which claims priority to Provisional U.S. Patent Application No. 62/524,130, filed Jun. 23, 2017, the disclosures of which are hereby incorporated by reference in their entireties.

FIELD

The present disclosure relates generally to gloves, and more particularly to athletic gloves for use during an athletic activity such as soccer.

BACKGROUND

This section provides background information related to the present disclosure which is not necessarily prior art.

Gloves generally include a palm side, a back side disposed on an opposite side of the glove than the palm side, finger sheaths spaced and sized to receive respective fingers of a human hand, and a thumb sheath spaced and sized to receive a thumb of a human hand. Gloves intended for athletic activities may include additional features such as hook-and-loop closure systems that allow for a cuff of the glove to be selectively and securely attached to a wrist of the user. Further, such gloves may additionally or alternatively include a leather or synthetic leather palm that provides friction between the palm side and a baseball bat or golf club, for example, during use depending on the particular activity for which the glove is intended. Such materials typically extend at least between the finger sheaths and a cuff of the glove to provide for increased grip during an athletic activity.

While conventional gloves adequately protect a user's hand during use and, further, may contribute to the user's ability to participate in an athletic activity, such gloves could be modified to both improve performance during use and, further, to reduce the costs associated with manufacturing the glove.

DESCRIPTION OF THE DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
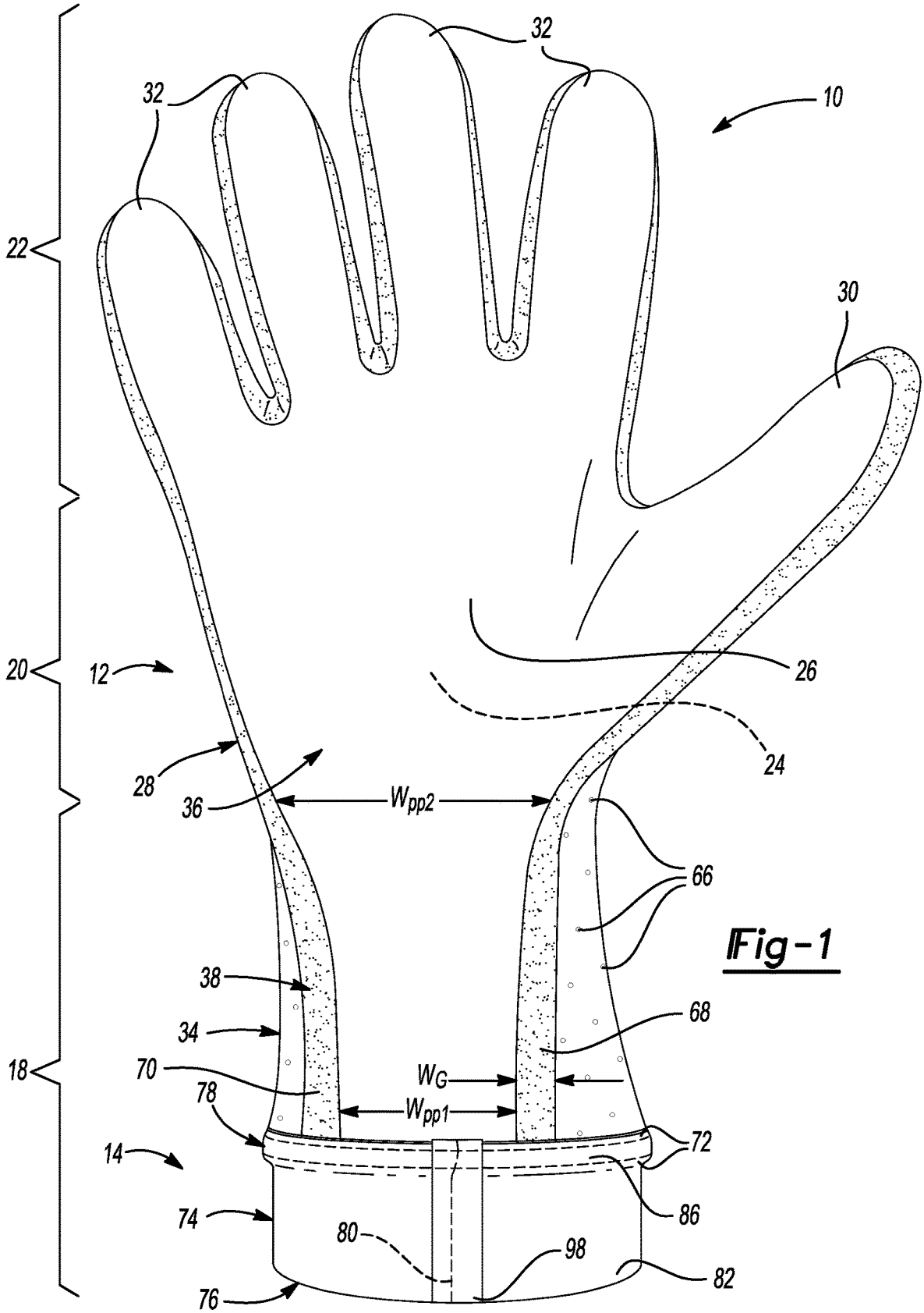
FIG. 1 is a front view of a glove in accordance with the principles of the present disclosure.

Example embodiments will now be described more fully with reference to the accompanying drawings. Example embodiments are provided so that this disclosure will be thorough, and will fully convey the scope of those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of moded features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With respect to the instant disclosure, the terms "breathability" and "air permeability" are used throughout the disclosure with respect to properties of materials. As is generally understood in the art, breathability of a material relates to an ability of a material to allow moisture vapor to be transmitted by a material, while air permeability relates to the ability of a material to allow air to pass through. Breathability and air permeability may both be determined using standardized tests, such as those provided by relevant ASTM and ISO standards. Accordingly, the use of these terms throughout this disclosure is to be interpreted in accordance with these plain meanings.

With reference to the figures, a glove is provided. The glove includes a cuff providing an opening to the glove. A back panel defines a first portion of finger sheaths and a thumb sheath and the back panel extends along the finger sheaths and the thumb sheath to the cuff. A palm panel is disposed on an opposite side of the glove from the back panel and defines a second portion of the finger sheaths and the thumb sheath. The palm panel is formed from a material having a greater coefficient of friction than a material of the back panel and extends along the finger sheaths and the thumb sheath to the cuff. The palm panel tapers in a direction from the finger sheaths to the cuff. A gusset extends between and is attached to the back panel and the palm panel and is formed from a different material than the back panel and the palm panel.

In one configuration, the gusset defines a third portion of the finger sheaths and the thumb sheath.

The material of the palm panel may have a greater coefficient of friction than a material of the gusset.

The gusset may extend continuously from a first end in contact with the cuff at a first location to a second end in contact with the cuff at a second location different than the first location. Further, the gusset may include a constant width along a length of the gusset from the first end to the second end.

A material of the gusset may have a greater elasticity than the material of the palm panel.

In another configuration, a glove is provided and includes a cuff providing an opening to the glove. A back panel defines a first portion of finger sheaths and a thumb sheath. The back panel extends along the finger sheaths and the thumb sheath to the cuff. A palm panel is disposed on an opposite side of the glove from the back panel and defines a second portion of the finger sheaths and the thumb sheath. The palm panel is formed from a material having a greater coefficient of friction than a material of the back panel and extends along the finger sheaths and the thumb sheath to the cuff. A gusset extends between and is attached to the back panel and the palm panel and is formed from a different material than the back panel and the palm panel. The gusset increases in width in a direction from the thumb sheath to the cuff.

The gusset may define a third portion of the finger sheaths and the thumb sheath.

The material of the palm panel may include a greater coefficient of friction than a material of the gusset.

The gusset may extend continuously from a first end in contact with the cuff at a first location to a second end in contact with the cuff at a second location, different from the first location.

The palm panel may flare in a direction from the finger sheaths to the cuff.

The gusset may increase in width in a direction from one of the finger sheaths to the cuff.

In yet another configuration, a cuff for a glove having an inner surface and an outer surface is provided. The cuff includes a base region formed at a first end of the cuff and defining an opening into the glove. The base region may comprise a continuously formed band. A first portion and a second portion are formed at a second end of the cuff. The first portion and the second portion each have first ends joined to the base region and second ends extending away from the base region. The first portion is attached to the inner surface of the glove and the second portion is attached to the outer surface of the glove.

In an alternative configuration, a glove is provided. The glove has a cuff providing an opening to the glove. A back panel defines a first portion of finger sheaths and a thumb sheath, and extends along the finger sheaths and the thumb sheath to the cuff. The back panel is formed of a first material having a first elasticity. A palm panel is disposed on an opposite side of the glove than the back panel and defines a second portion of the finger sheaths and the thumb sheath. The palm panel extends along the finger sheaths and the thumb sheath to the cuff and is formed from a second material having an elasticity less than or equal to the first elasticity of the first material of the back panel. A gusset extends between and is attached to the back panel and the palm panel and is formed from a third material having a greater elasticity than the first material of the back panel and the second material of the palm panel.

The cuff may be formed from a fourth material having a greater elasticity than the first material of the back panel, the second material of the palm panel, and the third material of the gusset.

A width of the gusset at the cuff may be between approximately two percent (2%) and approximately five percent (5%) of the total outer circumference of the glove at the cuff.

A percent elongation of the gusset may be more than approximately twice a percent elongation of the palm panel when an outer circumference of the glove is expanded by 50 percent (50%).

The first material of the back panel may include a greater air permeability than the second material of the palm panel.

The third material of the gusset may include a greater air permeability than the first material of the back panel and the second material of the palm panel.

In one configuration, a length of a wrist region of the glove may be greater than approximately one-third (⅓) of a total length of the glove. In another configuration, a length of a wrist region of the glove may be less than or equal to approximately one-third (⅓) of a total length of the glove.

The first portion may be continuous and may extend in a first direction from the first end. The second portion may also be continuous and may extend in a second direction from the first end. The second portion may circumscribe the first portion.

The glove may be received intermediate the first portion and the second portion.

Each of the first portion of the cuff and the second portion of the cuff may be joined to the glove using a lockstitch. Further, the lockstitch may be a zigzag lockstitch.

The cuff may include a tab extending from the first end to the second end. Further, the cuff may be formed of a material having a greater elasticity than the tab. Further yet, the tab may extend from the first end to the second end along an inner surface of the cuff, around the second end, and from the second end to the first end along an outer surface of the cuff.

The glove may comprise a back panel defining a first portion of finger sheaths and a thumb sheath. The back panel extends along the finger sheaths and the thumb sheath to the cuff. A palm panel may be disposed on an opposite side of the glove than the back panel and may define a second portion of the finger sheaths and the thumb sheath. The palm panel may be formed from a material having a greater coefficient of friction than a material of the back panel and may extend along the finger sheaths and the thumb sheath to the cuff. A gusset may extend between and may be attached to the back panel and the palm panel. In one configuration, the gusset may be formed from a different material than the back panel and the palm panel. The gusset may increase in width in a direction from the thumb sheath to the cuff. Further, the gusset may continuously extend from a first end in contact with the cuff at a first location to a second end in contact with the cuff at a second location. The first location may be different than the second location. Additionally, the back panel, the palm panel, the first end of the gusset, and the second end of the gusset may be received intermediate the first portion of the cuff and the second portion of the cuff.

The cuff may be formed from a different material than the glove.

In yet another configuration, a glove is provided and includes a cuff providing an opening to the glove. A back panel defines a first portion of finger sheaths and a thumb sheath. The back panel extends along the finger sheaths and the thumb sheath to the cuff, and is formed of a first material having a first breathability. A palm panel is disposed on an opposite side of the glove than the back panel and defines a second portion of the finger sheaths and the thumb sheath. The palm panel extends along the finger sheaths and the thumb sheath to the cuff, and is formed from a second material having less breathability than the first material of the back panel. A gusset extends between and is attached to the back panel and the palm panel and is formed from a third material having greater breathability than the first material of the back panel and the second material of the palm panel.

The third material of the gusset may have a greater elasticity than the first material of the back panel and the second material of the palm panel. Further, the cuff may be formed of a fourth material having a greater elasticity than the first material of the back panel, the second material of the palm panel, and the third material of the gusset.

A width of the gusset at the cuff may be between approximately two percent (2%) percent and approximately seven percent (7%) of the total outer circumference of the glove at the cuff.

A percent elongation of the gusset may be more than approximately twice a percent elongation of the palm panel when an outer circumference of the glove is expanded by 50 percent.

In one configuration, the back panel may include perforations formed therein.

The first material of the back panel may have a greater air permeability than the second material of the palm panel. Additionally, the third material of the gusset may have a greater air permeability than the first material of the back panel and the second material of the palm panel.

A length of a wrist region of the glove may be greater than approximately one-third (⅓) of a total length of the glove.

With reference to FIGS. 1-5, a glove 10 is provided and includes a glove member 12 and a cuff 14 joined to the glove member 12. The cuff 14 provides an opening 16 to the glove 10. The glove 10 may be divided into one or more regions including a wrist region 18, a palm region 20, and a phalangeal region 22. The wrist region 18 generally includes portions of the glove 10 corresponding with the wrist and lower portions of the arm. The palm region 20 generally includes portions of the glove 10 corresponding with metacarpal bones of the hand. In addition, the phalangeal region 22 generally includes portions of the glove 10 corresponding with the phalanges of the hand (i.e. the thumb and fingers). The glove 10 may additionally include a back side 24 and a palm side 26 that correspond with opposite sides of the glove 10 and extend through the regions 18, 20, 22.

Referring to FIGS. 1-4, the glove member 12 has a body 28 and a plurality of sheaths 30, 32 extending from the body 28. The body 28 of the glove member 12 generally receives a palm of a hand therein, and may extend into the wrist region 18 to receive a portion of a wrist. The sheaths 30, 32 are generally formed in the phalangeal region 22 of the glove 10 and may be characterized as a thumb sheath 30 and one or more finger sheaths 32, which correspond with a thumb and fingers of the hand, respectively. As shown in FIGS. 1-4, the finger sheaths 32 are individually formed such that each of the finger sheaths 32 is configured to receive a single finger therein. Alternatively, a single finger sheath may be configured to receive multiple fingers therein, such as in a mitten or a "three-finger" glove, for example.

Referring again to FIGS. 1-5, the body 28 and sheaths 30, 32 of the glove member 12 are defined by a back panel 34 disposed substantially on the back side 24 of the glove 10, a palm panel 36 disposed on the palm side 26 of the glove 10, and a gusset 38 extending between and attached to the back panel 34 and the palm panel 36. Respective inner surfaces 40, 42, 44 of the back panel 34, the palm panel 36, and the gusset 38 collectively provide an inner surface 46 of the glove member 12, which defines an interior void 48 of the glove member 12 that receives the hand. The back panel 34, the palm panel 36, and the gusset 38 further include respective outer surfaces 50, 52, 54 formed on opposite sides from the respective inner surfaces 40, 42, 44. Surfaces 50, 52, and 54 collectively provide an outer surface 56 of the glove member 12, as shown in FIG. 3. Terminal ends 58, 60, 62 of each of the back panel 34, the palm panel 36, and the gusset 38, respectively, collectively define a terminal end 64 of the glove member 12, which provides an opening into the interior void 48, as shown in FIG. 5.

Figure 2:
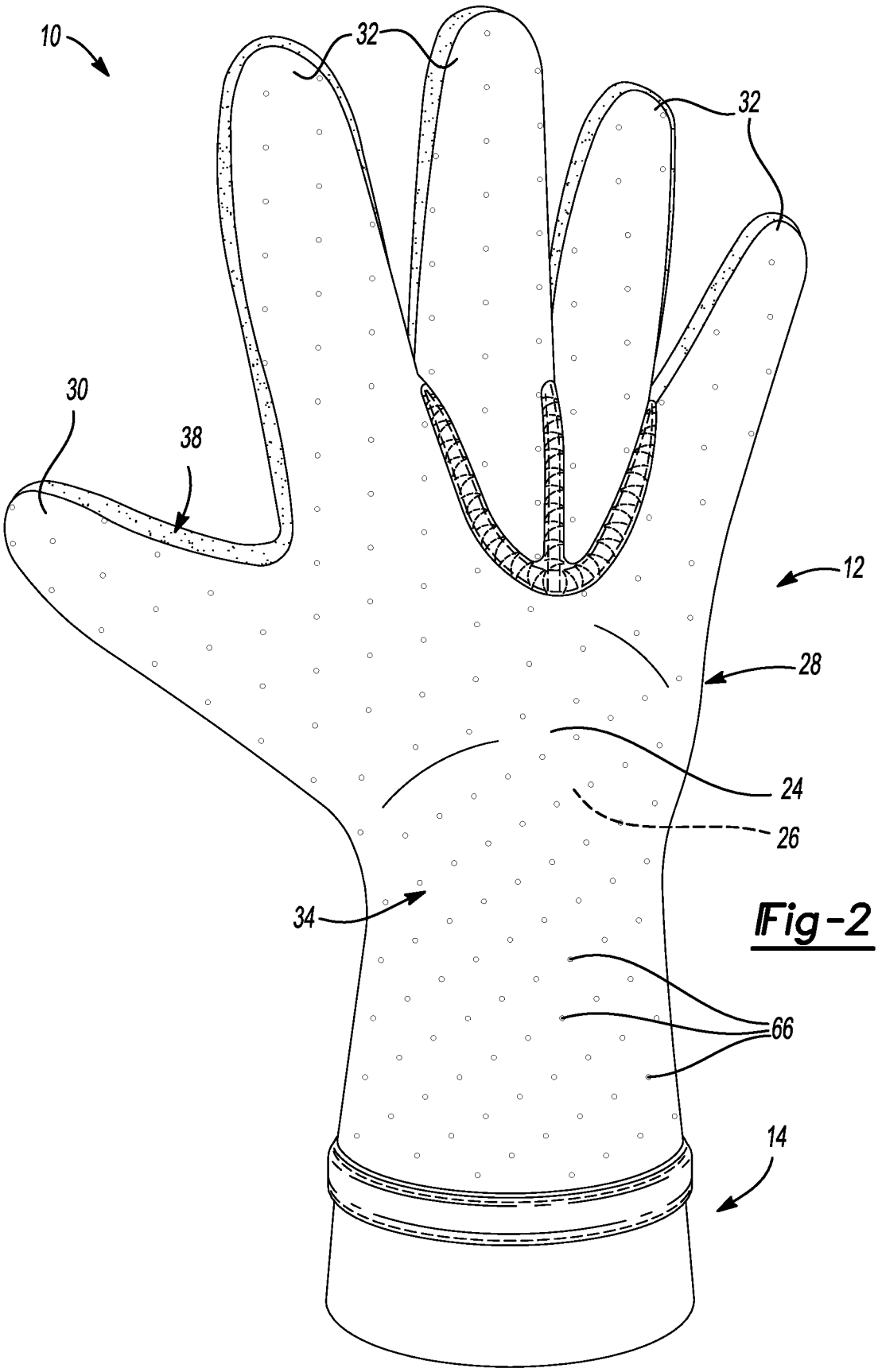
FIG. 2 is a back view of the glove of FIG. 1.
Figure 3:
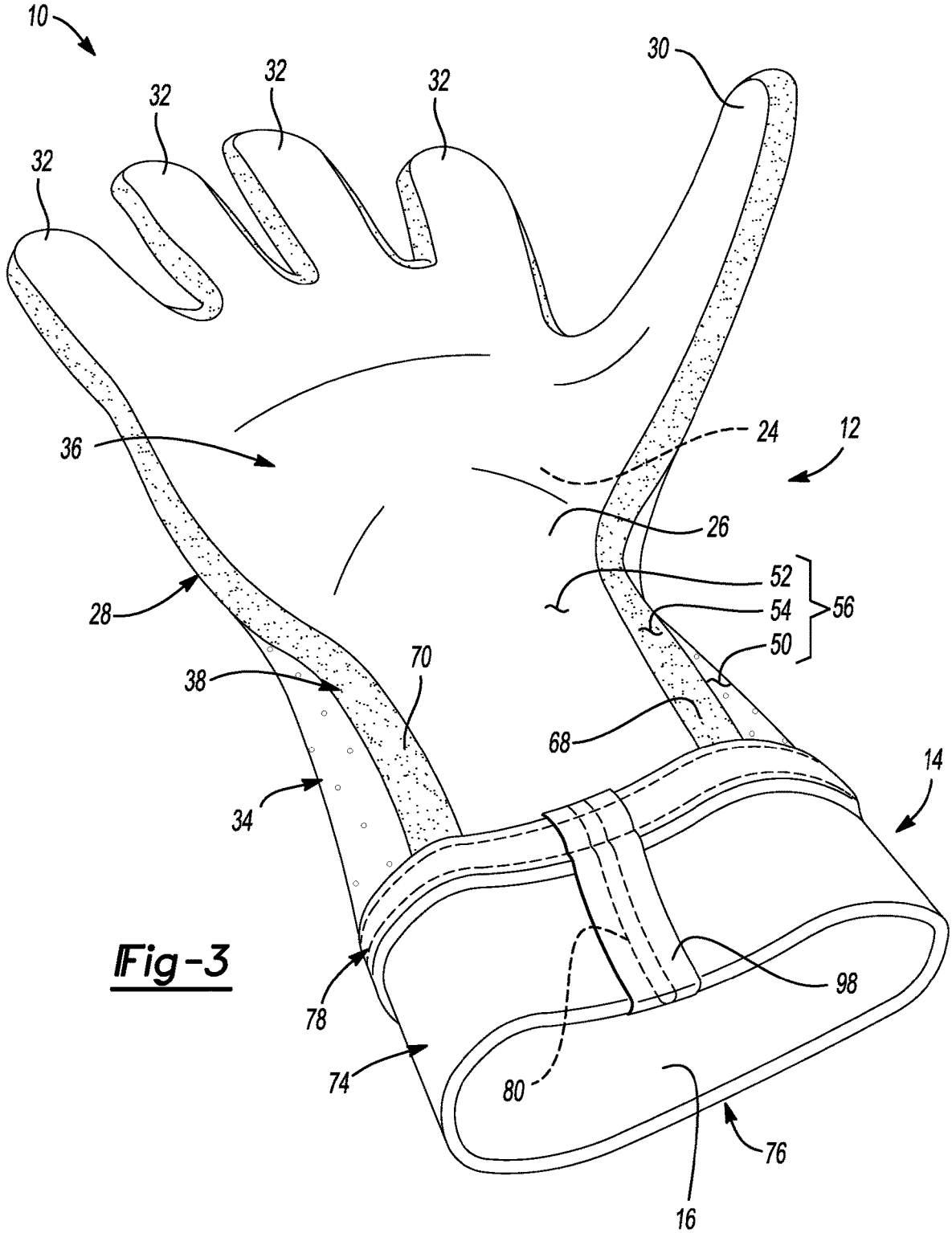
FIG. 3 is a perspective view of the glove of FIG. 1.

With reference to FIG. 2, the back panel 34 of the glove member 12 defines a first portion of each of the sheaths 30, 32 and the body 28 of the glove member 12. The back panel 34 extends along the sheaths 30, 32 and the body 28 to the cuff 14, primarily along the back side 24 of the glove 10. In the illustrated configuration, a portion of the back panel 34 extends around a wrist region 18 of the glove 10 to form a portion of the palm side 26 of the glove member 10, as shown in FIGS. 1-3. In other configurations, the back panel 34 may extend around the glove 10 in any one or more of the regions 18, 20, 22.

As shown in FIG. 2, the back panel 34 may be formed of individual pieces of material joined together along their respective seams. For example, in the configuration of FIG. 2, the first portions of a ring finger sheath 32 and a middle finger sheath 32 are formed as separate pieces from the first portion of the body 28. Each of the pieces of material is joined together along respective seams to form the back panel 34. In other examples, any one of the first portions of the sheaths 30, 32 may be separately formed from the body 28. The pieces of material may be joined using conventional methods, such as stitching, adhesive bonding, and melding, for example. Alternatively, the back panel 34 may be integrally formed, such that the first portions of each of the sheaths 30, 32 and the body 28 of the glove member 12 are all formed as a single piece of material, absent any seams.

The back panel 34 may be formed of an elastic first material that provides relatively high air permeability and breathability. For example, the back panel 34 may be formed of a polymer foam material. Alternatively or additionally, the back panel 34 may include natural or synthetic elastic materials such as textiles, synthetic fabrics, latex, rubber, or the like. Further, the back panel 34 may be a laminate including layers of the materials selected and arranged to impart desired properties of durability, air-permeability, wear-resistance, flexibility, and comfort to the hand while disposed within the interior void 48. For example, the back panel 34 may include a cloth material layer forming the inner surface 40, a polymer foam material layer disposed adjacent the fabric layer, and a mesh reinforcing layer disposed adjacent the polymer foam to provide durability. Any one or more of the layers of material forming the back panel 34 may include perforations 66 formed therein to further improve breathability, air permeability, and elasticity of the back panel 34. In alternate examples, the material forming the back panel 34 may be formed without the perforations 66.

With reference to FIGS. 1 and 3, the palm panel 36 of the glove member 12 defines a second portion of each of the sheaths 30, 32 and the body 28 of the glove member 12, and extends along the sheaths 30, 32 to the cuff 14 of the glove 10. In the wrist region 18 of the glove 10, the palm panel 36 may taper inwardly in a direction from the sheaths 30, 32 to the cuff 14, such that a width of the palm panel 36 is greater at an end of the wrist region 18 adjacent the palm region 20 than at the terminal end 60 of the palm panel 36. For instance, a width $W_{PP1}$ of the palm panel 36 at the terminal end 60 may be between approximately 60 percent (60%) and approximately 80 percent (80%) and, more particularly, between approximately 65 percent (65%) and approximately 75 percent (75%), of a width $W_{PP2}$ of the palm panel 36 at the end of the wrist region 18 adjacent the palm region 20. In one example, when a total outer circumference of the terminal end 64 of the glove member 12 measures approximately 203 mm, the palm panel 36 tapers from the first width $W_{PP2}$ of approximately 60 mm at the end of the wrist region 18 adjacent the palm region 20 to the second width $W_{PP1}$ of approximately 42 mm at the terminal end 60 of the palm panel 36.

In one configuration, the taper is constant generally from the palm region 20 to the terminal end 60 of the palm panel 36. Alternatively, the palm panel 36 may have a constant width through the wrist region 18, whereby the width is reduced as compared to a width of the palm panel 36 within the palm region 20. Finally, the palm panel 36 may taper outwardly along a direction from the sheaths 30, 32 to the cuff 14.

When the glove 10 is in a relaxed state, the width $W_{PP1}$ of the terminal end 60 of the palm panel 36 may range from approximately 15 percent (15%) to approximately 30 percent (30%), and more particularly, from approximately 18 percent (18%) to approximately 22 percent (22%), of the total outer circumference at the terminal end 64 of the glove member 12. For example, in one configuration, the total circumference of the outer surface 56 at the terminal end 64 of the glove member 12 measures approximately 203 mm, while the width $W_{PP1}$ at the terminal end 60 of the palm panel 36 is approximately 42 mm. It will be appreciated that the actual widths of the palm panel 36 may be dependent on an overall size of the glove 10, and may be larger or smaller in other sizes of gloves 10, but may still be within the aforementioned ranges with respect to the relative percentage of the total outer circumference of the glove member 12.

As shown, the palm panel 36 may be continuously formed, such that the second portion of each of the finger sheaths 32 and the body 28 of the glove member 12 are integrally formed of a single piece of material. However, the palm panel 36 may be formed of multiple pieces joined together along respective seams to form the finger sheaths 32 and the body 28, as described above with respect to the back panel 34. The pieces may be joined by conventional methods used to join materials. For example, stitching, adhesives, and/or melding may be used.

In the illustrated example, the palm panel 36 is formed of an elastic second material, different from the first material of the back panel 34. Particularly, the outer surface 52 of the palm panel 36 is formed of a material having a greater coefficient of friction than the material forming the outer surface 50 of the back panel 34, such as, for example, neoprene, latex, silicone, urethane or other materials providing a desirable coefficient of friction. Like the back panel 34, the palm panel 36 may be a laminate including layers of materials. For example, the palm panel 36 may include a cloth material layer forming the inner surface 42, and a synthetic material layer forming the outer surface 52. Regardless of whether the palm panel 36 is formed of a single layer of material or as a laminate, the overall elasticity of the palm panel 36 may be less than or equal to an overall elasticity of the back panel 34.

Referring again to FIGS. 1 and 3, an entirety of the outer surface 52 of the palm panel 36 of the glove 10 shown is substantially smooth, and is continuously formed without perforations, pads, interruptions or other features. However, in alternate configurations, the outer surface 52 of the palm panel 36 may include pads (none shown) for providing an increased coefficient of friction or cushioning. Additionally or alternatively, the palm panel 36 may include perforations (not shown) for improving breathability, similar to the perforations 66 included in the back panel 34.

Although the breathability and the air permeability of the material forming the palm panel 36 may be the same as the breathability and the air permeability of the material forming the back panel 34, the overall breathability and air permeability of the palm panel 36 may be less than that of the back panel 34 due to the absence of the perforations 66 from the palm panel 36.

The gusset 38 extends between the back panel 34 and the palm panel 36, and defines a third portion of each of the sheaths 30, 32 and the body 28 of the glove member 12. With reference to FIGS. 1-5, the gusset 38 extends continuously from a first end 68 in contact with the cuff 14 at a first location to a second end 70 in contact with the cuff 14 at a second location. More specifically, the gusset 38 may extend from the first end 68 disposed on the palm side 26 of the glove 10, circumscribe a periphery of each of the sheaths 30, 32 between the back side 24 and the palm side 26, and terminate at the second end 70 disposed on the palm side 26 of the glove 10, as shown in FIGS. 1-5. When the palm panel 36 is tapered through the wrist region 18, as provided above, the first end 68 and the second end 70 may converge towards each other along the direction from the sheaths 30, 32 to the cuff 14 and may terminate at the same side of the glove 10 (i.e., at the palm panel 36). Alternatively, a spacing between the first end 68 and the second end 70 of the gusset 38 may remain substantially constant through the wrist region 18 of the glove 10.

The gusset 38 may include a constant width $W_G$ along a length of the gusset 38 from the first end 68 to the second end 70, as shown in FIGS. 1-5. For example, as discussed above, when the palm panel 36 is tapered through the wrist region 18 of the glove 10 and the back panel 34 extends into the palm side 26 of the wrist region 18, the width $W_G$ of the gusset 38 is constant from the first end 68 to the second end 70. In an alternate configuration, the gusset 38 may include a variable width $W_G$ along the length of the gusset 38, such as around any one of the sheaths 30, 32 or along the body 28.

In the illustrated configuration, when the glove member 12 is in a relaxed state, the width $W_G$ of the gusset 38 is constant front the first end 68 to the second end 70, and may range from approximately 2 percent (2%) to approximately 7 percent (7%), and more particularly, from approximately 3 percent (3%) to approximately 4 percent (4%), of the total outer circumference of the glove member 12 at the terminal end 64. For instance, in one example, the total outer circumference at the terminal end 64 of the glove member 12 measures approximately 203 mm when the glove member 12 is in the relaxed state, while the width $W_G$ of the gusset 38 measures approximately 7 mm. It will be appreciated that the actual widths $W_G$ of the gusset 38 may be dependent on an overall size of the glove 10, and may be larger or smaller in other sizes of gloves 10, but may still be within the aforementioned ranges with respect to the relative percentage of the total outer circumference of the glove member 12.

The gusset 38 is formed of a third material having a greater elasticity than the palm panel 36 and the back panel 34. For instance, when a circumferential tensile stress is applied to the glove member 12, such as by inserting a hand into the interior void 48, the material of the gusset 38 will stretch more easily (i.e. lower Young's modulus) and to a greater extent (i.e. higher strain to failure) than the materials of the back panel 34 and the palm panel 36. Properties related to relative elasticity of the materials may be determined using standardized tests, such as those provided by relevant ASTM and ISO standards. In one demonstration of the relative elasticity of the materials forming the glove member 12, the terminal end 64 of the glove member 12 was stretched circumferentially by approximately 54 percent, from approximately 203 mm in the relaxed state to approximately 312 mm in a stretched state. As shown in Table 1, below, the terminal ends 58, 60 of each of the back panel 34 and the palm panel 36 stretched substantially proportionally to the glove member 12. Particularly, the terminal end 60 of the back panel 34 stretched approximately 50 percent, while the terminal end 60 of the palm panel 36 stretched approximately 49 percent. Referring again to Table 1, when the terminal end 64 of the glove member 12 was expanded to the stretched state, the measured widths $W_G$ each of the first end 68 and the second end 70 of the gusset 38 increased from approximately 7 mm to approximately 15 mm, an approximate 114 percent elongation compared to the relaxed state. Accordingly, the material forming the gusset 38 increased more than twice as much as the material forming either the back panel 34 or the palm panel 36.

TABLE 1

Percent Elongation of Glove Member Components

| Element | Measured Width Relaxed State (mm) | Measured Width Stretched State (mm) | Percent Elongation |
|---|---|---|---|
| Main Body (Terminal End) | 203 | 312 | 54% |
| Gusset - First End (Terminal End) | 7 | 15 | 114% |
| Gusset - Second End (Terminal End) | 7 | 15 | 114% |
| Palm Panel (Terminal End) | 42 | 63 | 50% |
| Back Panel (Terminal End) | 147 | 219 | 49% |

Additionally or alternatively, the material forming the gusset 38 may have greater breathability and/or air permeability than the materials forming the back panel 34 and the palm panel 36, such that the gusset 38 provides venting between the interior chamber 48 and the atmosphere. Suitable materials for the gusset 38 may include one or more of nylon, polyester, elastane, or the like. The elasticity of the gusset 38 allows the glove member 12 to expand and contract to accommodate insertion of a hand into the interior void 48, and to accommodate various sizes of hands within the interior void 48.

With reference to FIG. 5, the gusset 38 may be joined to each of the back panel 34 and the palm panel 36 using a plain seam, such that the outer surface 54 of the gusset 38 and the outer surface 50, 52 of one of the back panel 34 and the palm panel 36 are placed face-to-face, and then seamed together. Likewise, the outer surface 54 of the gusset 38 and the outer surface 50, 52 of the other of the back panel 34 and the palm panel 36 are placed face-to-face and seamed together. As shown in FIG. 5, the back panel 34, the palm panel 36, and the gusset 38 may be seamed to each other using stitching 72, such as a straight lockstitch, for example. However, the gusset 38 may be joined to one or both of the panels 34, 36 using adhesive bonding, melding, or the like.

Figure 4:
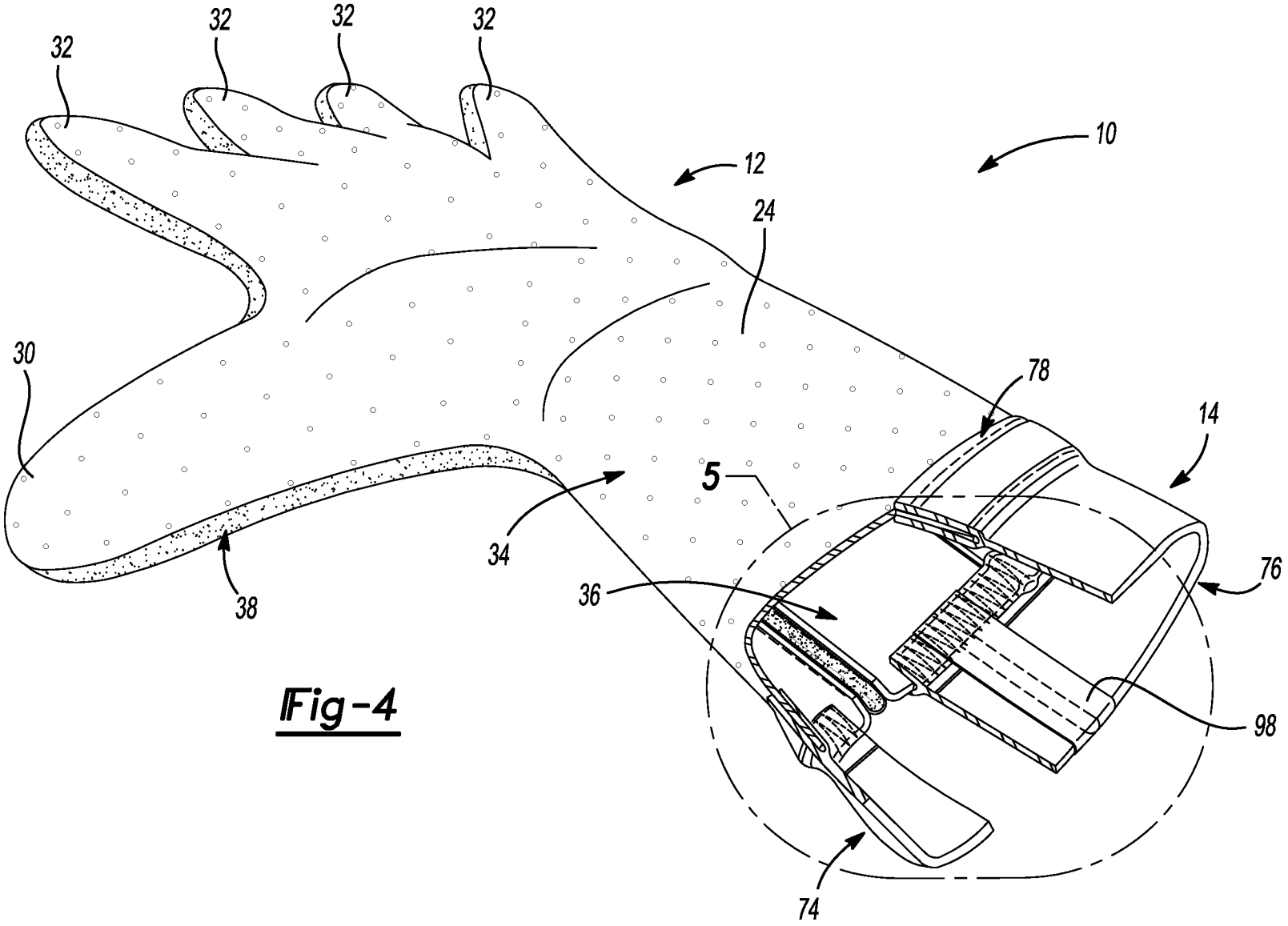
FIG. 4 is a perspective view of the glove of FIG. 1 having a cutaway portion to illustrate a construction of a cuff of the glove.
Figure 5:
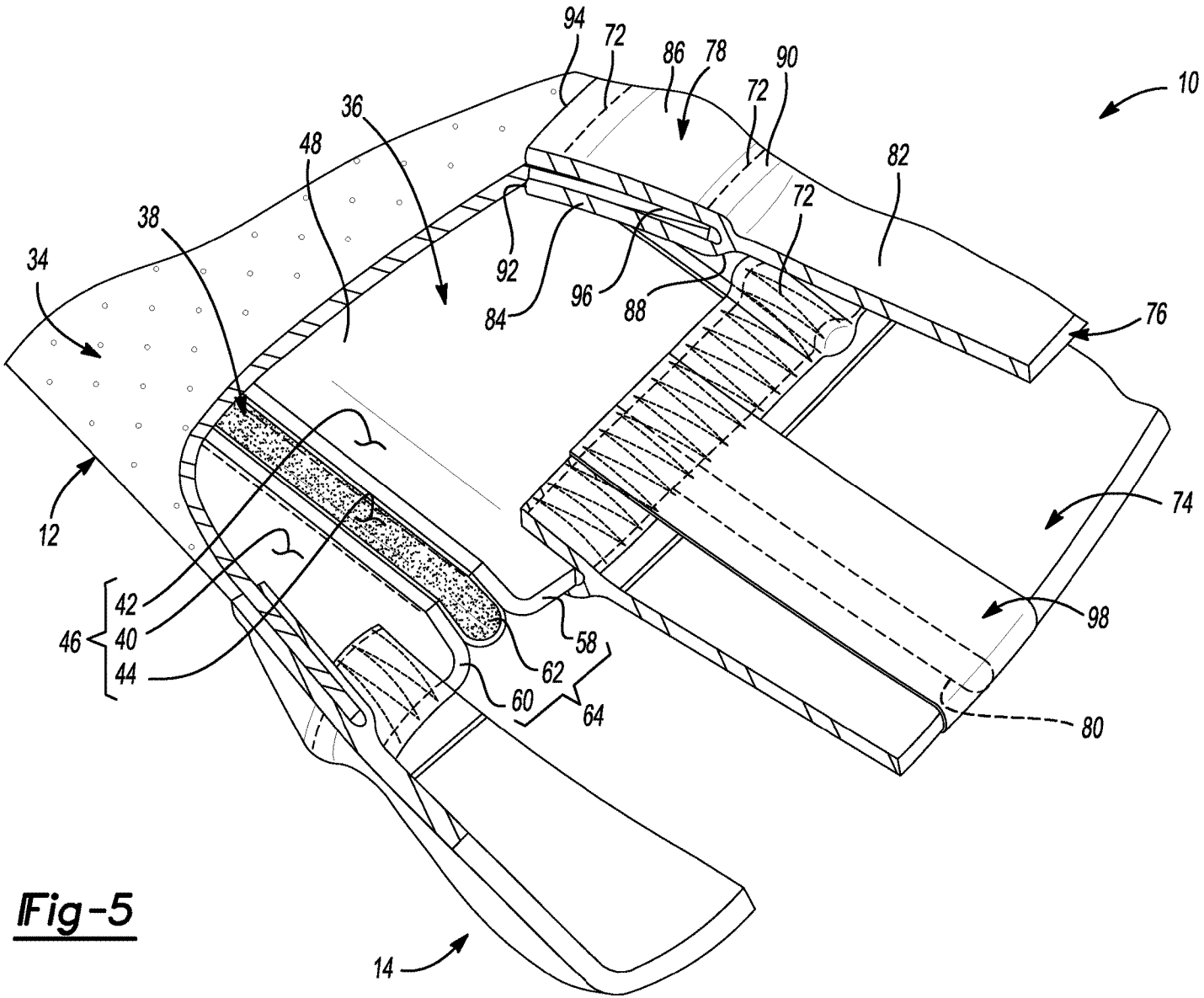
FIG. 5 is an enlarged partial perspective view of the glove of FIG. 1, taken at Area 5 of FIG. 4, and showing the cut-away portion of the cuff.

With particular reference to FIGS. 4 and 5, the cuff 14 includes a continuous band 74 having a first end 76 defining the opening 16 to the glove 10 and a second end 78 attached to the glove member 12. In the configuration shown in FIG. 5, the band 74 is formed by joining opposing ends of a strip of material to form a continuous loop, such that a seam 80 of the band 74 extends from the first end 76 to the second end 78. In other examples, the band 74 may be molded or extruded, such that it forms a continuous loop without any seams.

The cuff 14 is formed of a fourth material having a greater elasticity than the palm panel 36, the back panel 34, and the gusset 38, such that an outer circumference of the cuff 14 can be expanded to a greater extent than the outer circumference of the terminal end 64 of the glove member 12. Put another way, when a circumferential tensile stress is applied to the cuff 14, such as by inserting a hand into the opening 16, the cuff 14 will stretch more easily (i.e. lower Young's modulus) and to a greater extent (i.e. higher strain to failure) than the materials forming the back panel 34, the palm panel 36, and the gusset 38. By forming the cuff 14 of the glove 10 of a material having a greater elasticity than the materials forming the glove member 12, the cuff 14 of the glove 10 can advantageously expand to accommodate the insertion of the hand through the opening 16, and subsequently contract to embrace the wrist or lower arm of the user, thereby securing the glove 10 without the need for manual adjustment of a circumference of the cuff 14.

The first end 76 of the band 74 includes a unitary base portion 82. As shown in FIG. 5, the base portion 82 may comprise a single layer of material. Alternatively, the base portion 82 of the band 74 may be a laminate having multiple layers of material joined together. Regardless of the particular construction of the base portion 82, the base portion 82 may be formed from a material providing the base portion 82 with a degree of stretch to allow the cuff 14 to expand when a hand is inserted therethrough.

The second end 78 of the band 74 includes a first portion 84 and a second portion 86 divergently extending from the base portion 82, such that the band 74 has a Y-shaped cross section, as detailed in FIG. 5. As such, each of the first portion 84 and the second portion 86 are attached to the base portion 82 at first ends 88, 90, while distal second ends 92, 94 extend away from the base portion 82.

As shown, the second portion 86 is spaced laterally outwardly of the first portion 84, and circumscribes an entirety of the first portion 84 such that a continuously formed channel 96 is formed at the second end 78 of the band 74, intermediate the first portion 84 and the second portion 86. In other configurations, either one of the first portion 84 and the second portion 86 may be discontinuous, such that the channel 96 is formed intermittently around the second end 78 of the band 74.

In one configuration, the first portion 84 and the second portion 86 may be integrally formed with the base portion 82, such that each of the base portion 82, the first portion 84, and the second portion 86 are formed from a single piece of material, as shown in FIG. 5. For example, the band 74 may be formed of "Y-tape," whereby the first portion 84 and the second portion 86 are integrally formed with the base portion 82. In another configuration, one or both of the first portion 84 and the second portion 86 may be separately formed from the base portion 82, and joined to the base portion 82 using any conventional method for joining fabrics, such as stitching, adhesive bonding, melding, or a combination thereof.

Referring again to FIG. 5, when the glove 10 is assembled, the cuff 14 is attached to the glove member 12 such that the first portion 84 attaches to the inner surface 46 of the glove member 12 and the second portion 86 attaches to the outer surface 56 of the glove member 12. As such, the terminal end 64 of the glove member 12 may be received within the channel 96 of the cuff 14, intermediate the first portion 84 and the second portion 86.

The first portion 84 and the second portion 86 are attached to the opposing surfaces 46, 56 of the glove member 12 using longitudinally-stretchable stitching 72, such that the stitching 72 allows the band 74 of the cuff 14 to expand circumferentially and accommodate the insertion of a hand. In the configuration shown in FIG. 5, the stitching 72 is a three-thread zigzag lockstitch. However, alternate types of stretchable stitching may be used. In alternate configurations, the first portion 84, the second portion 86, and the glove member 12 may be joined using an adhesive bonding, melding, or the like, provided the cuff 14 remains stretchable.

In the illustrated configuration of the glove 10, the terminal end 64 and the cuff 14 are formed below a wrist of a user, such that the cuff 14 receives a lower arm of the user when a hand is inserted into the interior void 48 of the glove 10. More specifically, a length of the wrist region 18 of the glove 10 measured from the first end 76 of the band 74 to the end of the wrist region 18 adjacent the palm region 20, and including the glove member 12 and the cuff 14, is greater than approximately one-third (⅓) of the total length of the glove 10, measured from the first end 76 of the band 74 to a distal end of the middle finger sheath 30. Likewise, a length of the portion of the glove member 12 extending through the wrist region 18, measured from the second end 78 of the band 74 to the end of the wrist region 18 adjacent the palm region 20, is approximately one-third (⅓) of the total length of the glove 10. In alternate configurations, the length of the wrist region 18 of the glove 10 and the length of the portion of the glove member 12 extending into the wrist region 18 may be less than or equal to approximately one-third (⅓) of the total length of the glove 10.

By extending the terminal end 64 of the glove member 12 beyond the wrist and onto the lower arm, several benefits are provided. For example, the protective and performance-related characteristics provided by the glove member 12 are further provided to a lower portion of an arm of a user, thereby improving comfort and performance during use. Additionally, the extended wrist region 18 of the glove 10, including the cuff 14, embraces the lower arm to provide improved security of the glove 10 on the hand.

The cuff 14 may further include a tab 98 attached to the band 74. In one configuration the tab 98 extends from the first end 76 to the second end 78 along an inner surface of the band 74, wraps around the second end 78, and extends back to the first end 76 along an outer surface of the band 74. With reference to FIG. 5, the tab 98 may cover the seam 80 of the band 74, such that the seam 80 is hidden inside of the tab 98 to improve the aesthetics of the glove 10. Further, the tab 98 may be joined to the band 74 on opposing sides of the seam 80 to provide reinforcement. For example, the tab 98 may be adhesively bonded to the band 74 on each side of the seam 80.

The tab 98 may be formed of a different material than the band 74, and have less elasticity than the cuff 14. Accordingly, the tab 98 may beneficially serve as a gripping portion of the cuff 14 for pulling the glove 10 onto the hand. As shown, the seam 80 and the tab 98 of the cuff 14 are centrally positioned on the palm side 26 of the glove 10 such that the tab 98 can be easily grabbed. In alternate configurations, either one of the seam 80 and the tab 98 may be offset on the palm side 26 of the glove 10, formed on the back side 24 of the glove 10, or formed on a portion of the band 74 intermediate the back side 24 and the palm side 26.

With reference to FIGS. 6-10, a glove 10*a* is provided and includes a glove member 12*a* and a cuff 14*a* joined to the glove member 12*a*. The cuff 14*a* provides an opening 16 to the glove 10*a*. In view of the substantial similarity in structure and function of the components associated with the glove 10*a* with respect to the glove 10, like reference numerals are used hereinafter and in the drawings to identify like components while like reference numerals containing letter extensions are used to identify those components that have been modified.

Referring again to FIGS. 6-9, the body 28 and sheaths 30, 32 of the glove member 12*a* are defined by a back panel 34*a* disposed substantially on the back side 24 of the glove 10*a*, a palm panel 36*a* disposed on the palm side 26 of the glove 10*a*, and a gusset 38*a* extending between and attached to the back panel 34*a* and the palm panel 36*a*. Respective inner surfaces 100, 101, 102 of the back panel 34*a*, the palm panel 36*a*, and the gusset 38*a* collectively provide an inner surface

Figure 10:
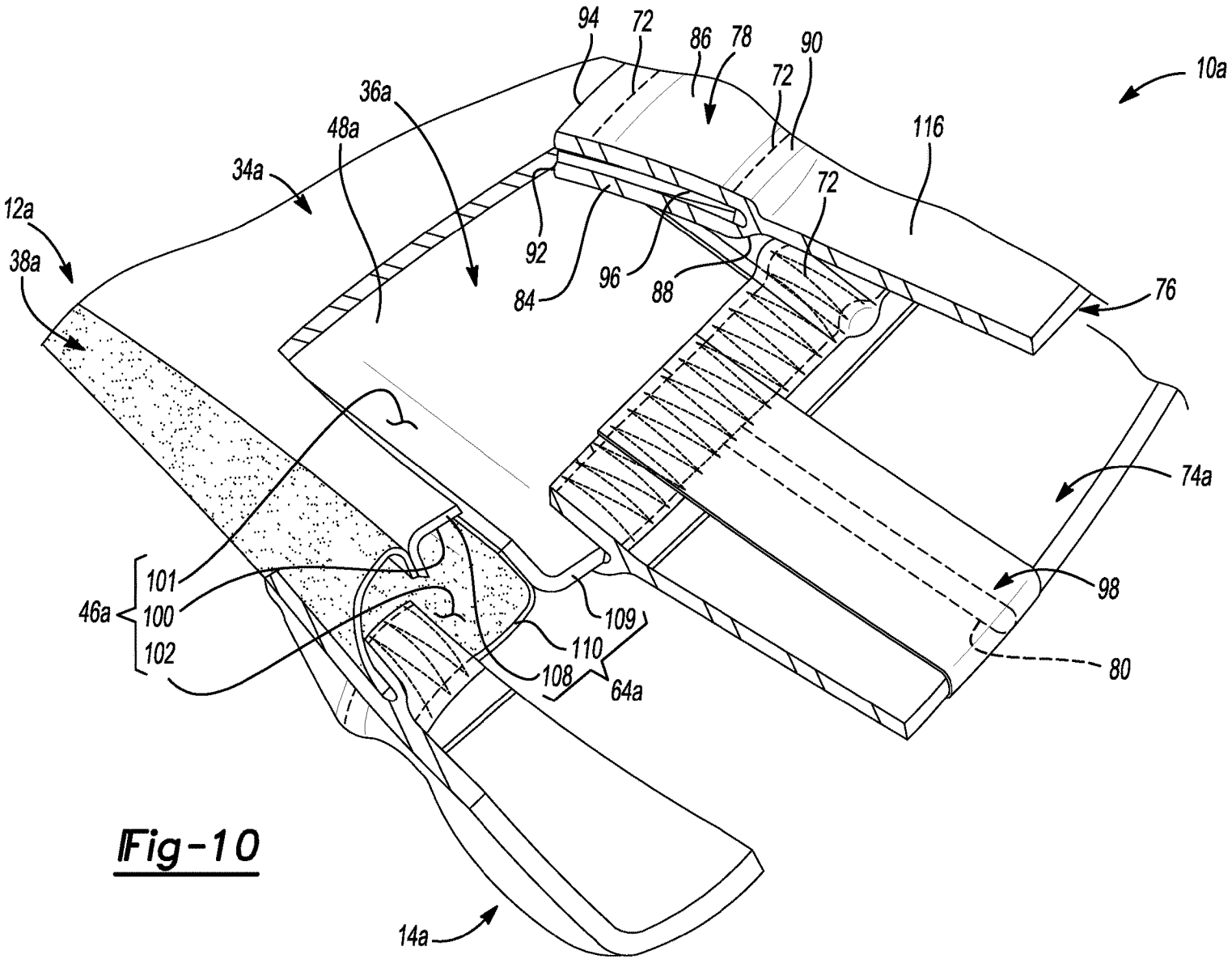
FIG. 10 is an enlarged partial perspective view of the glove of FIG. 9, taken at Area 10 of FIG. 9, and showing the cut-away portion of the cuff.

46*a* of the glove member 12*a*, which itself defines an interior void 48*a* of the glove member 12*a* that receives the hand. The back panel 34*a*, the palm panel 36*a*, and the gusset 38*a* further include respective outer surfaces 104, 105, 106 formed on opposite sides from the respective inner surfaces 100, 101, 102, and collectively provide an outer surface 56*a* of the glove member 12*a*. Terminal ends 108, 109, 110 of each of the back panel 34*a*, the palm panel 36*a*, and the gusset 38*a* collectively define a terminal end 64*a* of the glove member 12*a*, which provides an opening into the interior void 48*a*, as shown in FIG. 10.

Figure 7:
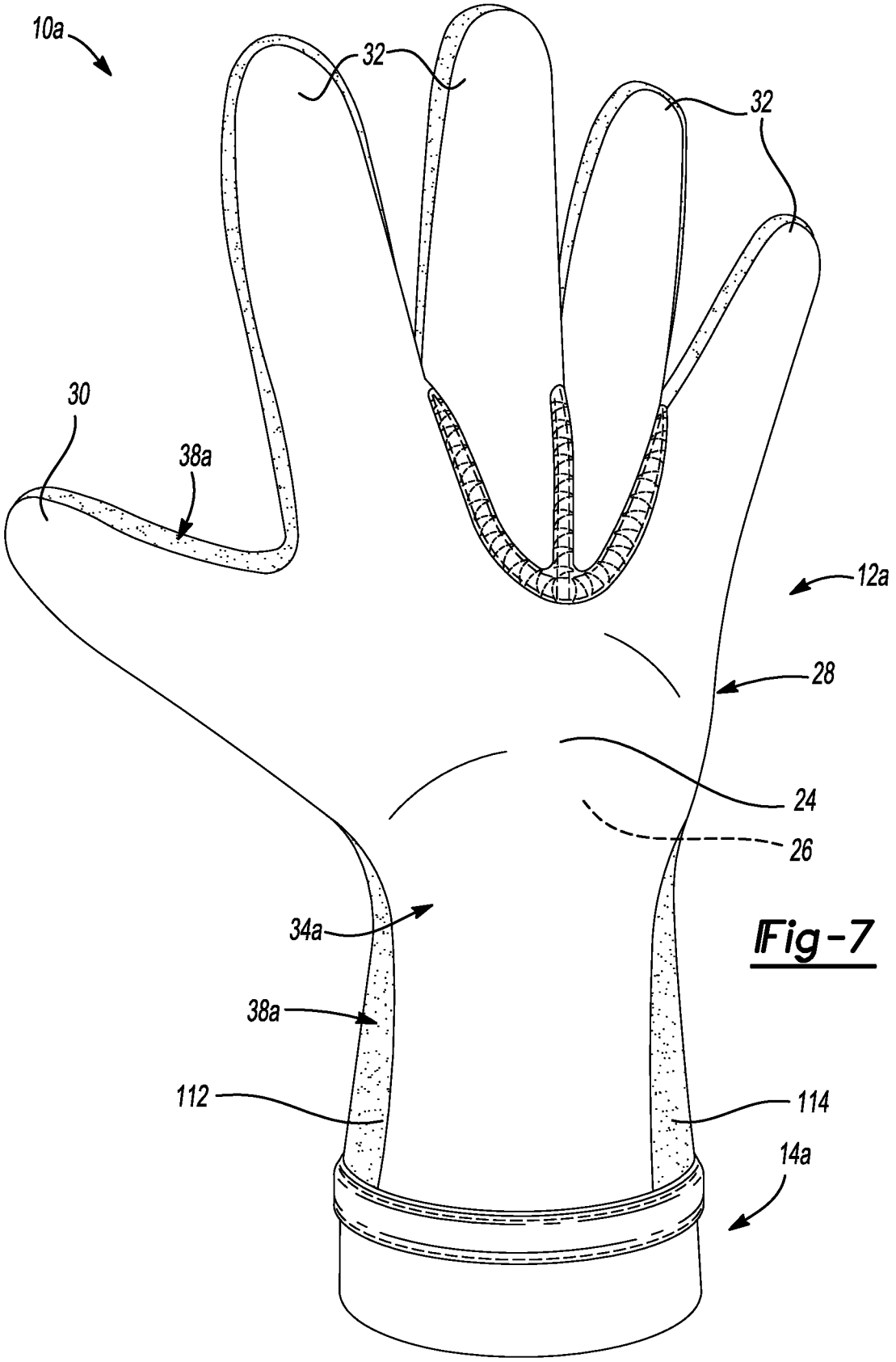
FIG. 7 is a back view of the glove of FIG. 6.

With reference to FIG. 7, the back panel 34*a* of the glove member 12*a* defines a first portion of each of the sheaths 30, 32 and the body 28 of the glove member 12*a*. The back panel 34*a* extends along the sheaths 30, 32 and the body 28 to the cuff 14*a*, primarily along the back side 24 of the glove 10*a*. In the configuration of FIG. 7, the back panel 34*a* is formed strictly on the back side 24 of the glove 10*a*. Like the palm panel 36*a*, the back panel 34*a* may taper inwardly in a direction from the sheaths 30, 32 to the cuff 14*a* through the wrist region 18 of the glove 10*a*. Accordingly, a width of the back panel 34*a* may be greater at an end of the wrist region 18 adjacent the palm region 20 than at the terminal end 108 of the back panel 34*a*. In one configuration, the taper is constant generally from the palm region 20 to the terminal end 108. Alternatively, the back panel 34*a* may have a constant width through the wrist region 18, whereby the constant width is reduced as compared to a width of the back panel 34 within the palm region 20. In alternate configurations the back panel 34*a* may extend around the glove member 12*a* to form a portion of the palm side 26 in any one of the regions 18, 20, 22, depending on a shape and arrangement of the palm panel 36*a* and the gusset 38*a*, as discussed below.

As shown in FIG. 7, the back panel 34*a* may be formed of individual sections of material joined together along their respective seams. For example, in the configuration of FIG. 7, the first portions of a ring finger sheath and a middle finger sheath are formed as separate sections from the first portion of the body 28. Each of the sections of material is joined together along respective seams to form the back panel 34*a*. In other examples, any one of the first portions of the sheaths 30, 32 may be separately formed from the body 28. The sections of material may be joined using conventional methods, such as stitching, adhesive bonding, and melding, for example. Alternatively, the back panel 34*a* may be integrally formed, such that the first portions of each of the sheaths 30, 32 and the body 28 of the glove member 12*a* are formed of a single piece of material, absent any seams.

The back panel 34*a* may be formed of an elastic first material that provides relatively high rates of air permeability and breathability, as those terms are commonly understood in the art. For example, the back panel 34*a* may be formed of a polymer foam material. Alternatively or additionally, the back panel 34*a* may include natural or synthetic elastic materials such as textiles, synthetic fabrics, latex, rubber, or the like. Further, the back panel 34*a* may be a laminate including layers of the materials selected and arranged to impart desired properties of durability, air-permeability, wear-resistance, flexibility, and comfort to the hand while disposed within the interior void 48*a*. For example, the back panel 34*a* may include a cloth material layer forming the inner surface 100, a polymer foam material layer adjacent the cloth material layer, and a mesh reinforcing layer adjacent the polymer foam to provide durability. In the illustrated configuration, the material of the back panel 34*a* is continuously formed, without any perforations or interruptions. However, in alternate examples, the back panel 34*a* may include perforations, similar to those shown in FIGS. 1-5.

Figure 6:
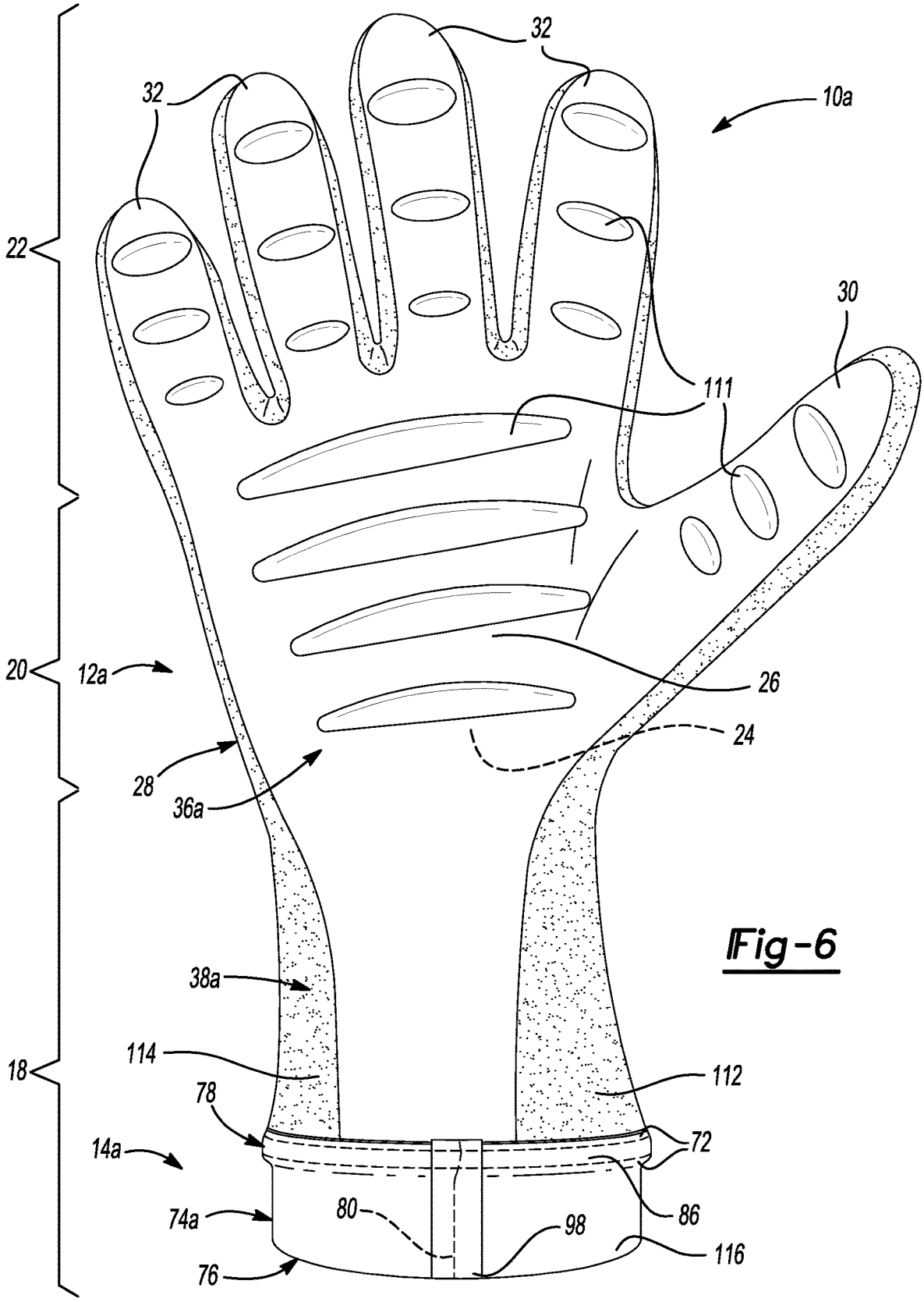
FIG. 6 is a front view of a glove in accordance with the principles of the present disclosure.
Figure 8:
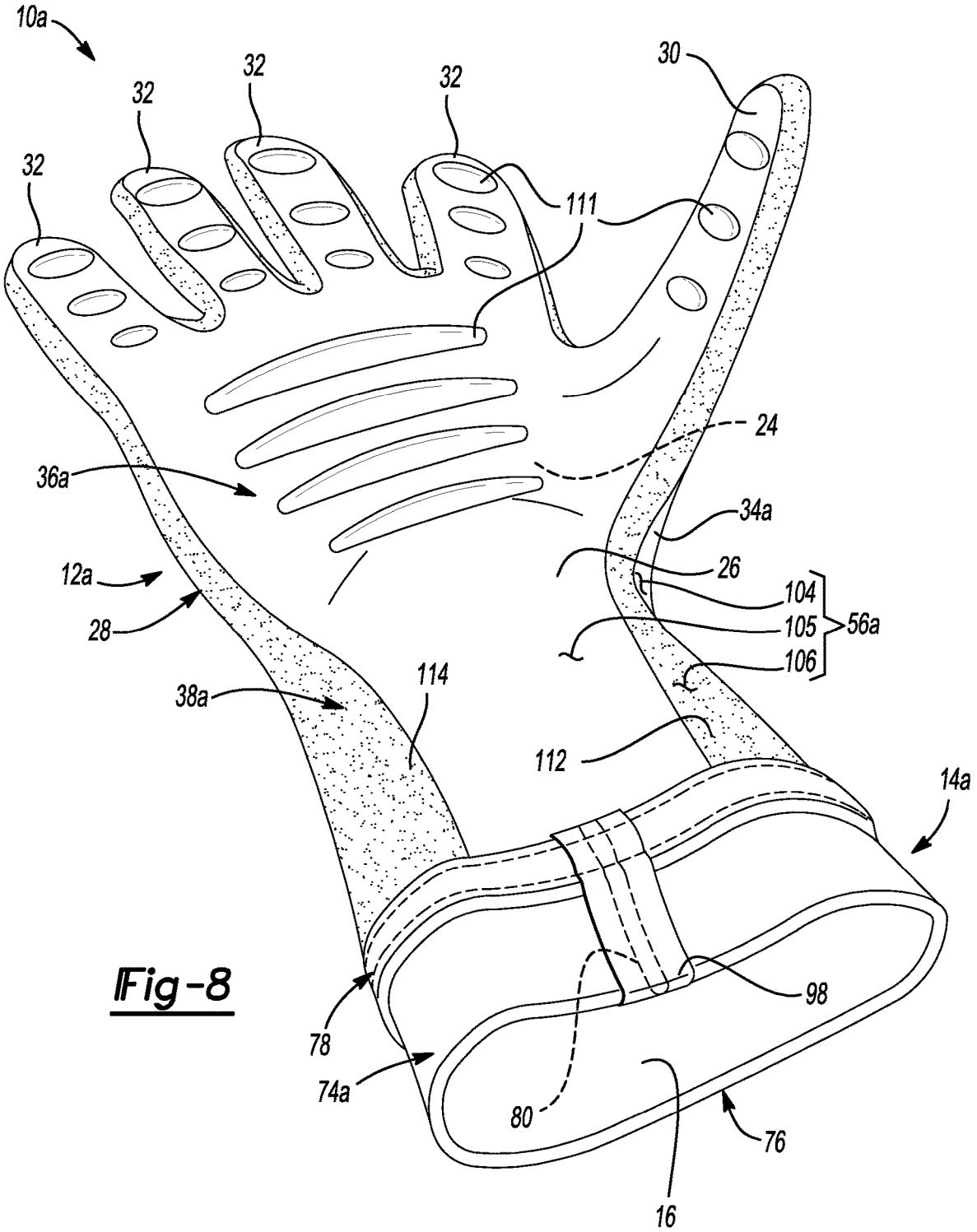
FIG. 8 is a perspective view of the glove of FIG. 6.
Figure 9:
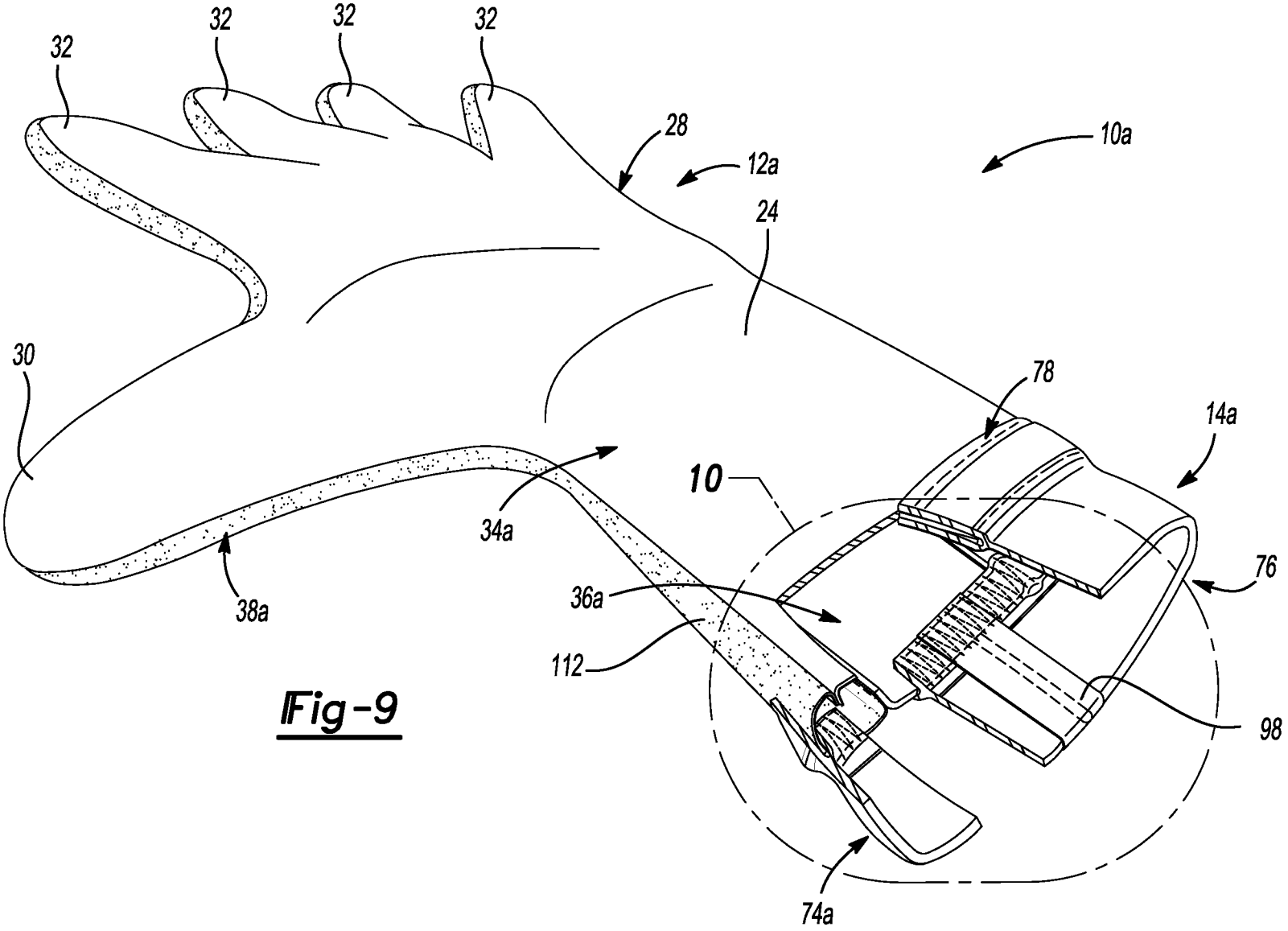
FIG. 9 is a perspective view of the glove of FIG. 6 having a cutaway portion to illustrate a construction of a cuff of the glove.

With reference to FIGS. 6 and 8, the palm panel 36*a* of the glove member 12*a* defines a second portion of each of the sheaths 30, 32 and the body 28 of the glove member 12*a*, and extends along the sheaths 30, 32 to the cuff 14*a* of the glove 10*a*. In the wrist region 18 of the glove 10*a*, the palm panel 36*a* may taper inwardly in a direction from the sheaths 30, 32 to the cuff 14*a*, such that a width of the palm panel 36*a* is greater at an end of the wrist region 18 adjacent the palm region 20 than at the terminal end 109 of the palm panel 36*a*. For instance, in one example the width of the palm panel 36*a* at the terminal end 109 is between approximately 60 percent (60%) and approximately 80 percent (80%), and more particularly, between approximately 65 percent (65%) and approximately 75 percent (75%), of the width of the palm panel 36*a* at the end of the wrist region 18 adjacent the palm region 20. In one example, when a total outer circumference of the terminal end 64 of the glove member 12 measures approximately 203 mm, the width of the palm panel 36 tapers from approximately 60 mm at the end of the wrist region 18 adjacent the palm region 20 to approximately 42 mm at the terminal end 60 of the palm panel 36.

In one configuration, the taper is constant generally from the palm region 20 to the terminal end 109 of the palm panel 36*a*. Alternatively, the palm panel 36*a* may have a constant width through the wrist region 18, whereby the width is reduced as compared to a width of the palm panel 36*a* within the palm region 20. Finally, the palm panel 36*a* may taper outwardly along a direction from the sheaths 30, 32 to the cuff 14*a*.

When the glove 10*a* is in a relaxed state, the width at the terminal end 109 of the palm panel 36*a* may range from approximately 15 percent (15%) to approximately 30 percent (30%), and more particularly, from approximately 18 percent (18%) to approximately 22 percent (22%), of the total outer circumference of the glove member 12*a* at the terminal end 64. For example, in one configuration, the total circumference of the outer surface 56 of the glove member 12*a* at the terminal end 64 measures approximately 203 mm, while the width of the palm panel 36*a* measures approximately 42 mm at the terminal end 109 of the palm panel 36*a*. It will be appreciated that the actual widths of the palm panel 36*a* may be dependent on an overall size of the glove 10*a*, and may be larger or smaller in other sizes of gloves 10*a*, but may still be within the aforementioned ranges of percentages with respect to the total outer circumference of the glove member 12*a*.

As shown, the palm panel 36*a* may be continuously formed, such that the second portion of each of the finger sheaths and the body 28 of the glove member 12*a* are integrally formed of a single piece of material. However, the palm panel 36*a* may be formed of multiple pieces joined together along respective seams to form the finger sheaths and body 28, as described above with respect to the back panel 34*a*. The pieces may be joined by conventional methods used to join materials. For example, stitching, adhesives, and/or melding may be used.

In the illustrated example, the palm panel 36*a* may be formed of the same elastic material as the back panel 34*a*. However, in alternate examples, the palm panel 36*a* may be formed of a different material than the back panel 34*a*. For example, the outer surface 105 of the palm panel 36*a* may be formed of a material having a greater coefficient of friction than the material forming the outer surface 104 of the back panel 34*a*, such as, for example, neoprene, latex, silicone, urethane or other materials providing a desirable coefficient of friction. Like the back panel 34*a*, the palm panel 36*a* may be a laminate including layers of materials. For example, the palm panel 36*a* may include a cloth material layer forming the inner surface 101, and a synthetic material layer forming the outer surface 105. Regardless of whether the palm panel 36*a* is formed of a single layer of material or as a laminate, the overall elasticity of the palm panel 36*a* may be less than or equal to an overall elasticity of the back panel 34*a*.

Referring again to FIGS. 6 and 8, the outer surface 105 of the palm panel 36*a* may include pads 111 formed thereon. The pads 111 may provide areas having a higher coefficient of friction than the outer surface 105 of the palm panel 36*a*, especially when then palm panel 36*a* is formed of the same material as the back panel 34*a*. In one configuration, the pads 111 are formed substantially flush with the outer surface 105, such that a height of the pads 111 is imperceptible to the eye. For example, the pads 111 may be formed as a thin coating applied to the outer surface 105 of the palm panel 36*a*. Alternatively or additionally, the pads 111 may protrude from the outer surface 105 of the palm panel 36*a*, whereby the pads 111 are tactile. Thus, the pads 111 may provide additional cushioning and protection to the palm panel 36*a*. The pads 111 may be deposited on the outer surface 105 of the palm panel 36*a* as an aqueous coating, such as a water-based ink. The aqueous coating is then cured using ultraviolet light, evaporation, chemical reaction, heat, or the like. Alternatively or additionally, the pads 111 may be pre-formed of a solid material, and then applied to the outer surface 105. Other methods of applying the pads 111 will be appreciated by those skilled in the art.

The gusset 38*a* extends between the back panel 34*a* and the palm panel 36*a*, and defines a third portion of each of the sheaths 30, 32 and the body 28 of the glove member 12*a*. With reference to FIGS. 6-9, the gusset 38*a* extends continuously from a first end 112 in contact with the cuff 14*a* at a first location to a second end 114 in contact with the cuff 14*a* at a second location. More specifically, the gusset 38*a* may extend from the first location of the cuff 14*a*, circumscribe a periphery of each of the sheaths 30, 32 intermediate the palm side 26 and the back side 24, and terminate at the second location of the glove 10*a*, as shown in FIGS. 6-9. When the palm panel 36*a* is tapered through the wrist region 18, as provided above, the first end 112 and the second end 114 may converge towards each other along the direction from the sheaths 30, 32 to the cuff 14*a*. Alternatively, a spacing between the first end 112 and the second end 114 of the gusset 38*a* may remain constant generally through the wrist region 18 of the glove 10*a*.

Referring to FIGS. 6 and 7, a width of the gusset 38*a* may be variable. When the back panel 34*a* is formed strictly on the back side 24 of the glove 10*a*, the width of the gusset 38*a* may flare or increase through the wrist region 18 along the direction from the sheaths 30, 32 to the cuff 14*a*, while the portion of the gusset 38*a* circumscribing the periphery of the sheaths 30, 32 is of a generally constant width. In one configuration, the ends 112, 114 of the gusset 38*a* at the first and second locations of the cuff 14*a* may extend around the wrist region 18 from the back side 24 of the glove member 12*a* to the palm side 26 of the glove member 12*a*, as shown in FIGS. 6-10. In alternate configurations, the ends 112, 114 of the gusset 38*a* may be formed only on the back side 24 of the glove member 12*a*, or only on the palm side 26 of the glove member 12*a*. The flare of the gusset 38*a* accommodates a divergence between the back panel 34*a* and the tapered palm panel 36*a* along the direction from the sheaths 30, 32 to the cuff 14*a*, and provides maximized elasticity and comfort through the wrist region 18 of the glove 10*a*.

The gusset 38*a* is formed of a third material having a greater elasticity than the back panel 34*a* and the palm panel 36*a*, as discussed above with respect to the configuration shown in FIG. 1-5. Additionally or alternatively, the material forming the gusset 38*a* may have greater breathability and air permeability than the materials forming the back panel 34*a* and the palm panel 36*a*, such that the gusset 38*a* provides venting between the interior chamber 48*a* and an exterior atmosphere. Suitable materials may include one or more of nylon, polyester, elastane, or the like. The elasticity of the gusset 38*a* allows the glove member 12*a* to expand and contract to accommodate the insertion of the hand into the interior void 48*a*, and to accommodate various sizes of hands within the interior void 48*a*.

With reference to FIG. 10, the gusset 38*a* may be joined to each of the back panel 34*a* and the palm panel 36*a* using a plain seam, such that the outer surface 106 of the gusset 38*a* and the outer surface 104, 105 of one of the back panel 34*a* and the palm panel 36*a* are placed face-to-face, and then seamed together. Likewise, the outer surface 106 of the gusset 38*a* and the outer surface 104, 105 of the other of the back panel 34*a* and the palm panel 36*a* are placed face-to-face and seamed together. As shown in FIG. 10, the back panel 34*a*, the palm panel 36*a*, and the gusset 38*a* may be seamed to each other using stitching 72, such as a straight lockstitch, for example. However, the gusset 38*a* may be joined to one or both of the panels 34*a*, 36*a* using adhesive bonding, melding, or the like.

With reference to FIGS. 6-10, the cuff 14*a* of the illustrated configuration of the glove 10*a* is substantially similar in structure and function to the cuff 14 of the glove 10 shown in FIGS. 1-5, as indicated by like reference numerals. However, as illustrated, a length of the cuff 14*a* is less than a length of the cuff 14 shown in FIGS. 1-5. Particularly, a base portion 116 of the band 74*a* of the cuff 14*a* shown in FIGS. 6-10 may be a lesser length than the base portion 82 of the band 74 of the cuff 14 shown in FIGS. 1-5. In alternate configurations, the glove 10*a* of FIGS. 6-10 may be fitted with the extended cuff 14 according to FIGS. 1-5.

Referring again to FIG. 10, when the glove 10*a* is assembled, the cuff 14*a* is attached to the glove member 12*a* such that the first portion 84 attaches to the inner surface 46*a* of the glove member 12*a* and the second portion 86 attaches to the outer surfaces 56*a* of the glove member 12*a*. As such, the terminal end 64*a* of the glove member 12*a* may be received within the cuff 14*a*, intermediate the first portion 84 and the second portion 86.

The first portion 84 and the second portion 86 are attached to the opposing surfaces 46*a*, 56*a* of the glove member 12*a* using longitudinally-stretchable stitching 72, such that the stitching 72 allows the band 74 of the cuff 14*a* to expand circumferentially to accommodate the insertion of a hand. In the configuration shown in FIG. 10, the stitching 72 is a three-thread zigzag lockstitch. However, alternate types of stretchable stitching may be used. In alternate configurations, the first portion 84, the second portion 86, and the glove member 12*a* may be joined using an adhesive bonding, melding, or the like, so long as the joint remains stretchable.

Each of the foregoing gloves 10, 10*a* respectively incorporates a glove member 12, 12*a* and a cuff 14, 14*a* that provide maximized grip and comfort to a user during use of the particular glove 10, 10*a*. More specifically, by forming the body 28 to have a tapered palm panel 36*a* through the wrist region 18, breathability, comfort, and performance of the glove 10, 10*a* are maximized. Particularly, the material forming the outer surface 52, 105 of the palm panel 36, 36*a*—having a relatively high coefficient of friction—is provided only along as much of the wrist region 18 as is necessary to maximize grip. By wrapping the back panel 34 around the wrist region 18 (FIG. 1-5) or by flaring the gusset 38*a* (FIGS. 6-10), a portion of the palm side 26 of the wrist region 18 is provided with a comfortable, breathable material, such as polymer foam or nylon, without detrimentally affecting the grip of the glove 10, 10*a*.

Although two configurations of the glove 10, 10*a* are provided with distinct arrangements and features, it will be appreciated that any of the features of either one of the gloves 10, 10*a* may be provided with or without any of the features of the other one of the gloves 10, 10*a*. For example, the glove 10 shown in FIGS. 1-5 may be fitted with the cuff 14*a* or glove member 12*a*, or any features thereof, of the glove 10*a* of FIGS. 6-10. Alternatively, the glove 10*a* shown in FIGS. 6-10 may include the cuff 14 or glove member 12, or any features thereof, of the glove 10 of FIGS. 1-5.

Further, although the glove 10, 10*a* of the instant disclosure is discussed and depicted as having the configuration of a soccer goalkeeper glove 10 or a field-player glove 10*a*, concepts associated with the glove 10, 10*a* may be applied to various types of athletic gloves. In addition to a soccer goalkeeper glove 10 and field-player glove 10*a*, therefore, concepts discussed herein may be applied to hockey gloves, ski gloves, and weightlifting gloves, for example. In addition, concepts discussed herein may be applied to various types of gloves such as, for example, welding gloves, oven mitts, and all-purpose work gloves.

The following Clauses provide an exemplary configuration for a method of forming a foldable bag described above.

Clause 1: A glove comprising: a cuff providing an opening to the glove; a back panel defining a first portion of finger sheaths and a thumb sheath, the back panel extending along the finger sheaths and the thumb sheath to the cuff; a palm panel disposed on an opposite side of the glove than the back panel and defining a second portion of the finger sheaths and the thumb sheath, the palm panel formed from a first material having a greater coefficient of friction than a second material of the back panel, extending along the finger sheaths and the thumb sheath to the cuff, and tapering in a direction from the finger sheaths to the cuff; and a gusset extending between and attached to the back panel and the palm panel and formed from a different material than the back panel and the palm panel.

Clause 2: The glove of Clause 1, wherein the gusset defines a third portion of the finger sheaths and the thumb sheath.

Clause 3: The glove of Clause 1, wherein the material of the palm panel includes a greater coefficient of friction than a material of the gusset.

Clause 4: The glove of Clause 1, wherein the gusset extends from a first end in contact with the cuff at a first location continuously to a second end in contact with the cuff at a second location different than the first location.

Clause 5: The glove of Clause 4, wherein the gusset includes a constant width along a length of the gusset from the first end to the second end.

Clause 6: The glove of Clause 1, wherein a material of the gusset includes a greater elasticity than the material of the palm panel.

Clause 7: A glove comprising: a cuff providing an opening to the glove; a back panel defining a first portion of finger sheaths and a thumb sheath, the back panel extending along the finger sheaths and the thumb sheath to the cuff; a palm panel disposed on an opposite side of the glove than the back panel and defining a second portion of the finger sheaths and the thumb sheath, the palm panel formed from a first material having a greater coefficient of friction than a second material of the back panel and extending along the finger sheaths and the thumb sheath to the cuff; and a gusset extending between and attached to the back panel and the palm panel and formed from a different material than the back panel and the palm panel, the gusset increasing in width in a direction from the thumb sheath to the cuff.

Clause 8: The glove of Clause 7, wherein the gusset defines a third portion of the finger sheaths and the thumb sheath.

Clause 9: The glove of Clause 7, wherein the material of the palm panel includes a greater coefficient of friction than a material of the gusset.

Clause 10: The glove of Clause 7, wherein the gusset extends from a first end in contact with the cuff at a first location continuously to a second end in contact with the cuff at a second location different than the first location.

Clause 11: The glove of Clause 7, wherein the palm panel tapers in a direction from the finger sheaths to the cuff.

Clause 12: The glove of Clause 7, wherein the gusset increases in width in a direction from one of the finger sheaths to the cuff.

Clause 13: A cuff for a glove including a glove having an inner surface and an outer surface, the cuff comprising: a base region formed at a first end of the cuff and defining an opening into the glove, the base region comprising a continuously formed band; and a first portion and a second portion formed at a second end of the cuff, the first portion and the second portion each having first ends joined to the base region and second ends extending away from the base region, the first portion attached to the inner surface of the glove, and the second portion attached to the outer surface of the glove.

Clause 14: The cuff of Clause 13, wherein the first portion is continuous and extends in a first direction from the first end, the second portion is continuous and extends in a second direction from the first end, and the second portion circumscribes the first portion.

Clause 15: The cuff of Clause 13, wherein the glove is received intermediate the first portion and the second portion.

Clause 16: The cuff of Clause 13, wherein each of the first portion of the cuff and the second portion of the cuff are joined to the glove using a lockstitch.

Clause 17: The cuff of Clause 16, wherein the lockstitch is a zigzag lockstitch.

Clause 18: The cuff of Clause 13, wherein the cuff includes a tab extending from the first end to the second end.

Clause 19: The cuff of Clause 18, wherein the cuff is formed of a material having a greater elasticity than the tab.

Clause 20: The cuff of Clause 18, wherein the tab extends from the first end to the second end along an inner surface of the cuff, around the second end, and from the second end to the first end along an outer surface of the cuff.

Clause 21: The cuff of Clause 13, wherein the glove comprises: a back panel defining a first portion of finger sheaths and a thumb sheath, the back panel extending along the finger sheaths and the thumb sheath to the cuff; a palm panel disposed on an opposite side of the glove from the back panel and defining a second portion of the finger sheaths and the thumb sheath, the palm panel formed from a first material having a greater coefficient of friction than a second material of the back panel and extending along the finger sheaths and the thumb sheath to the cuff; and a gusset extending between and attached to the back panel and the palm panel and formed from a different material than the back panel and the palm panel.

Clause 22: The glove of Clause 21, wherein the gusset extends from a first end in contact with the cuff at a first location continuously to a second end in contact with the cuff at a second location different than the first location.

Clause 23: The glove of Clause 22, wherein the back panel, the palm panel, the first end of the gusset, and the second end of the gusset are received intermediate the first portion of the cuff and the second portion of the cuff.

Clause 24: The glove of Clause 21, wherein the gusset increases in width in a direction from the thumb sheath to the cuff.

Clause 25: The glove of Clause 13, wherein the cuff is formed from a different material than the glove.

Clause 26: A glove comprising: a cuff providing an opening to the glove; a back panel defining a first portion of finger sheaths and a thumb sheath, the back panel extending along the finger sheaths and the thumb sheath to the cuff, the back panel formed of a first material having a first breathability; a palm panel disposed on an opposite side of the glove than the back panel and defining a second portion of the finger sheaths and the thumb sheath, the palm panel extending along the finger sheaths and the thumb sheath to the cuff, and formed from a second material having less breathability than the first material of the back panel; and a gusset extending between and attached to the back panel and the palm panel and formed from a third material having a greater breathability than the first material of the back panel and the second material of the palm panel.

Clause 27: The glove of Clause 26, wherein the third material of the gusset has a greater elasticity than the first material of the back panel and the second material of the palm panel.

Clause 28: The glove of Clause 27, wherein the cuff is formed of a fourth material having a greater elasticity than the first material of the back panel, the second material of the palm panel, and the third material of the gusset.

Clause 29: The glove of Clause 26, wherein a width of the gusset at the cuff is between approximately 2 percent (2%) and approximately 5 percent (5%) of the total outer circumference of the glove at the cuff.

Clause 30: The glove of Clause 26, wherein a percent elongation of the gusset is more than twice a percent elongation of the palm panel when an outer circumference of the glove is expanded by 50 percent (50%).

Clause 31: The glove of Clause 26, wherein the back panel includes perforations formed therein.

Clause 32: The glove of Clause 26, wherein the first material of the back panel has a greater air permeability than the second material of the palm panel.

Clause 33: The glove of Clause 26, wherein the third material of the gusset has a greater air permeability than the first material of the back panel and the second material of the palm panel.

Clause 34: The glove of Clause 26, wherein a length of a wrist region of the glove is greater than approximately one-third (⅓) of a total length of the glove.

Clause 35: A glove comprising: a cuff providing an opening to the glove; a back panel defining a first portion of finger sheaths and a thumb sheath, the back panel extending along the finger sheaths and the thumb sheath to the cuff, the back panel formed of a first material having a first elasticity; a palm panel disposed on an opposite side of the glove than the back panel and defining a second portion of the finger sheaths and the thumb sheath, the palm panel extending along the finger sheaths and the thumb sheath to the cuff, and formed from a second material having an elasticity less than or equal to the first elasticity of the first material of the back panel; and a gusset extending between and attached to the back panel and the palm panel and formed from a third material having a greater elasticity than the first material of the back panel and the second material of the palm panel.

Clause 36: The glove of Clause 35, wherein the cuff is formed of a fourth material having a greater elasticity than the first material of the back panel, the second material of the palm panel, and the third material of the gusset.

Clause 37: The glove of Clause 35, wherein a width of the gusset at the cuff is between approximately 2 percent (2%) and approximately 5 percent (5%) of the total outer circumference of the glove at the cuff.

Clause 38: The glove of Clause 35, wherein a percent elongation of the gusset is more than twice a percent elongation of the palm panel when an outer circumference of the glove is expanded by 50 percent (50%).

Clause 39: The glove of Clause 35, wherein the first material of the back panel has a greater air permeability than the second material of the palm panel.

Clause 40: The glove of Clause 35, wherein the third material of the gusset has a greater air permeability than the first material of the back panel and the second material of the palm panel.

Clause 41: The glove of Clause 35, wherein a length of a wrist region of the glove is greater than approximately one-third (⅓) of a total length of the glove.

Clause 42: The glove of Clause 35, wherein a length of a wrist region of the glove is less than or equal to approximately one-third (⅓) of a total length of the glove.

The foregoing description of the embodiments has been provided for purposes of illustration and description. It is not intended to be exhaustive or to limit the disclosure. Individual elements or feature of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A glove comprising:

a cuff providing an opening to the glove;

a back panel defining a first portion of finger sheaths and a thumb sheath, the back panel extending along the finger sheaths and the thumb sheath to the cuff;

a palm sided disposed on an opposite side of the glove than the back panel and including a palm panel defining a second portion of the finger sheaths and the thumb sheath, the palm panel formed from a first material having a greater coefficient of friction than a second material of the back panel, extending along the finger sheaths and the thumb sheath to the cuff, and tapering in a direction from the finger sheaths to the cuff; and a gusset formed from a different material than the back panel and the palm panel, extending continuously between and attached to the back panel and the palm panel, and extending from a first end disposed on the palm side to a second end disposed on the palm side, the first end and the second end being in contact with the cuff.

2. The glove of claim 1, wherein the gusset defines a third portion of the finger sheaths and the thumb sheath.

3. The glove of claim 1, wherein the first material includes a greater coefficient of friction than a material of the gusset.

4. The glove of claim 1, wherein the gusset includes a constant width along a length of the gusset from the first end to the second end.

5. The glove of claim 1, wherein a material of the gusset includes a greater elasticity than the first material of the palm panel.

6. A glove comprising:

a cuff providing an opening to the glove;

a back panel defining a first portion of finger sheaths and a thumb sheath, the back panel extending along the finger sheaths and the thumb sheath to the cuff;

a palm side disposed on an opposite side of the glove than the back panel and including a palm panel defining a second portion of the finger sheaths and the thumb sheath, the palm panel formed from a first material having a greater coefficient of friction than a second material of the back panel and extending along the finger sheaths and the thumb sheath to the cuff; and a gusset formed from a different material than the back panel and the palm panel, increasing in width in a direction from the thumb sheath to the cuff, extending continuously between and attached to the back panel and the palm panel, and extending from a first end disposed on the palm side to a second end disposed on the palm side, the first end and the second end in contact with the cuff.

7. The glove of claim 6, wherein the gusset defines a third portion of the finger sheaths and the thumb sheath.

8. The glove of claim 6, wherein the first material includes a greater coefficient of friction than a material of the gusset.

9. The glove of claim 6, wherein the palm panel tapers in a direction from the finger sheaths to the cuff.

10. The glove of claim 6, wherein the gusset increases in width in a direction from one of the finger sheaths to the cuff.

11. A cuff for a glove including an inner surface and an outer surface, the cuff comprising:

a base region formed at a first end of the cuff and defining an opening into the glove, the base region comprising a continuously formed band; and a first portion and a second portion formed at a second end of the cuff, the first portion and the second portion each having first ends joined to the base region and second ends extending away from the base region, the first portion attached to the inner surface of the glove, and the second portion attached to the outer surface of the glove.

12. The cuff of claim 11, wherein the first portion is continuous and extends in a first direction from the first end, the second portion is continuous and extends in a second direction from the first end, and the second portion circumscribes the first portion.

13. The cuff of claim 11, wherein the glove is received intermediate the first portion and the second portion.

14. The cuff of claim 11, wherein each of the first portion of the cuff and the second portion of the cuff are joined to the glove using a lockstitch.

15. The cuff of claim 14, wherein the lockstitch is a zigzag lockstitch.

16. The cuff of claim 11, wherein the cuff includes a tab extending from the first end to the second end.

17. The cuff of claim 16, wherein the cuff is formed of a material having a greater elasticity than the tab.

18. The cuff of claim 16, wherein the tab extends from the first end to the second end along an inner surface of the cuff, around the second end, and from the second end to the first end along an outer surface of the cuff.

* * * * *